US006578749B1

(12) United States Patent
Shen et al.

(10) Patent No.: US 6,578,749 B1
(45) Date of Patent: Jun. 17, 2003

(54) NAIL GUIDE DEVICE FOR A POWER NAILER

(75) Inventors: Yao-Sheng Shen, Taichung (TW); Guey-Hong Liou, Taichung (TW)

(73) Assignee: Basso Industry Corp., Taichung (TW)

( * ) Notice: Subject to any disclaimer, the term of this patent is extended or adjusted under 35 U.S.C. 154(b) by 0 days.

(21) Appl. No.: 10/313,458

(22) Filed: Dec. 6, 2002

(51) Int. Cl.[7] ..... B25C 1/04

(52) U.S. Cl. ..... 227/119; 227/120; 227/136; 227/123; 227/128

(58) Field of Search ..... 227/120, 119, 227/147, 136, 135, 137, 127, 128, 123

(56) References Cited

U.S. PATENT DOCUMENTS 5,316,200 A * 5/1994 Wallin ..... 227/119
5,452,835 A * 9/1995 Shkolnikov ..... 227/119
5,476,204 A * 12/1995 Eisenpresser et al. ..... 227/123
5,579,975 A * 12/1996 Moorman ..... 227/136
5,810,239 A * 9/1998 Stich ..... 227/123
6,279,808 B1 * 8/2001 Larsen ..... 227/119

* cited by examiner

*Primary Examiner*—Scott A. Smith
(74) *Attorney, Agent, or Firm*—Charles E. Baxley

(57) ABSTRACT

A nail guide device for a power nailer includes a nose portion and a guiding member mounted to the nose portion of the power nailer by a pin passing through a orifice of the guiding member and a pivot hole of the connecting portion. The passage of the leading edge contacts against the inside of the semi-circle passage by the virtue of a first end of a spring engaging to a protrusion of the connecting portion and a second end of a spring engaging to a bulge of the guiding member.

1 Claim, 7 Drawing Sheets

NAIL GUIDE DEVICE FOR A POWER NAILER

BACKGROUND OF THE INVENTION

1. Field of the Invention

The present invention relates to a nail guide device, and more particularly to an improved nail guide device for a power nailer, which has a guide device to facilitate accurate and consistent orientation and placement of nails as the nails exit the power nailer.

2. Description of the Prior Art

A Conventional nail guide device normally comprises a nose portion 10 and two guiding plates 20, as shown in FIG. 1. The nose portion 10 is formed at the end of a power nailer, and two stationary portions 11 are respectively formed on the upper and lower of the nose portion 10. Two positioning pins 13 are respectively located on each of the two stationary portions 11. Two recesses 14 are respectively formed at each of the two stationary portions 11 and two protrusions 15 are respectively formed on one end of each of the recesses 14. Each of the guiding plates 20 has a hole 22 for engaging with each of the positioning pins 13 of the two stationary portions 11. Two noses 23 are respectively formed on each of the guiding plates 20. Two springs 16 are received in the each of the recesses 14 and each engaged between each of the protrusions 15 of the recesses 14 and each of the noses 23 of the guiding plates 20 for biasing the guiding plates 20. In this device, a nail, by virtue of the springs 16, is guided parallel to the axis of the nose portion 10 by a guide surface 21 of the guiding plate 20 pushing against each other. However, while in the condition of the tension of the springs 23 are unequal, the nail will be tilted. Furthermore, the nail guide device for the conventional power nailer is difficult in assembling and cost too much.

The present invention has arisen to mitigate and/or obviate the afore-described disadvantages of the conventional nail guide device.

SUMMARY OF THE INVENTION

In accordance with one aspect of the present invention, there is provided a nail guide device comprises a gap portion of a muzzle of a power nailer and a guiding plate affixed to a fix member of the gap portion, a protrusion of the guiding plate contacts against an interior surface of a semi-tubular member of the gap.

The primary object of the invention is to provide a nail guide device for a power nailer which is capable of guiding the movement direction of the nail in the nose portion parallel to the axis of the nose portion of a power nailer and hammered vertically into a work piece.

Another object of the present invention is to provide a nail guide device for a power nailer which is more simple both in structure and assembly.

A further object of the present invention is to provide a nail guide device for a power nailer which is compact in size and cost-saved in material.

The present invention will become more obvious from the following description when taken in connection with the accompanying drawings which show, for purposes of illustration only, several preferred embodiments in accordance with the present invention.

DETAILED DESCRIPTION OF THE PREFERRED EMBODIMENT

Figure 1:
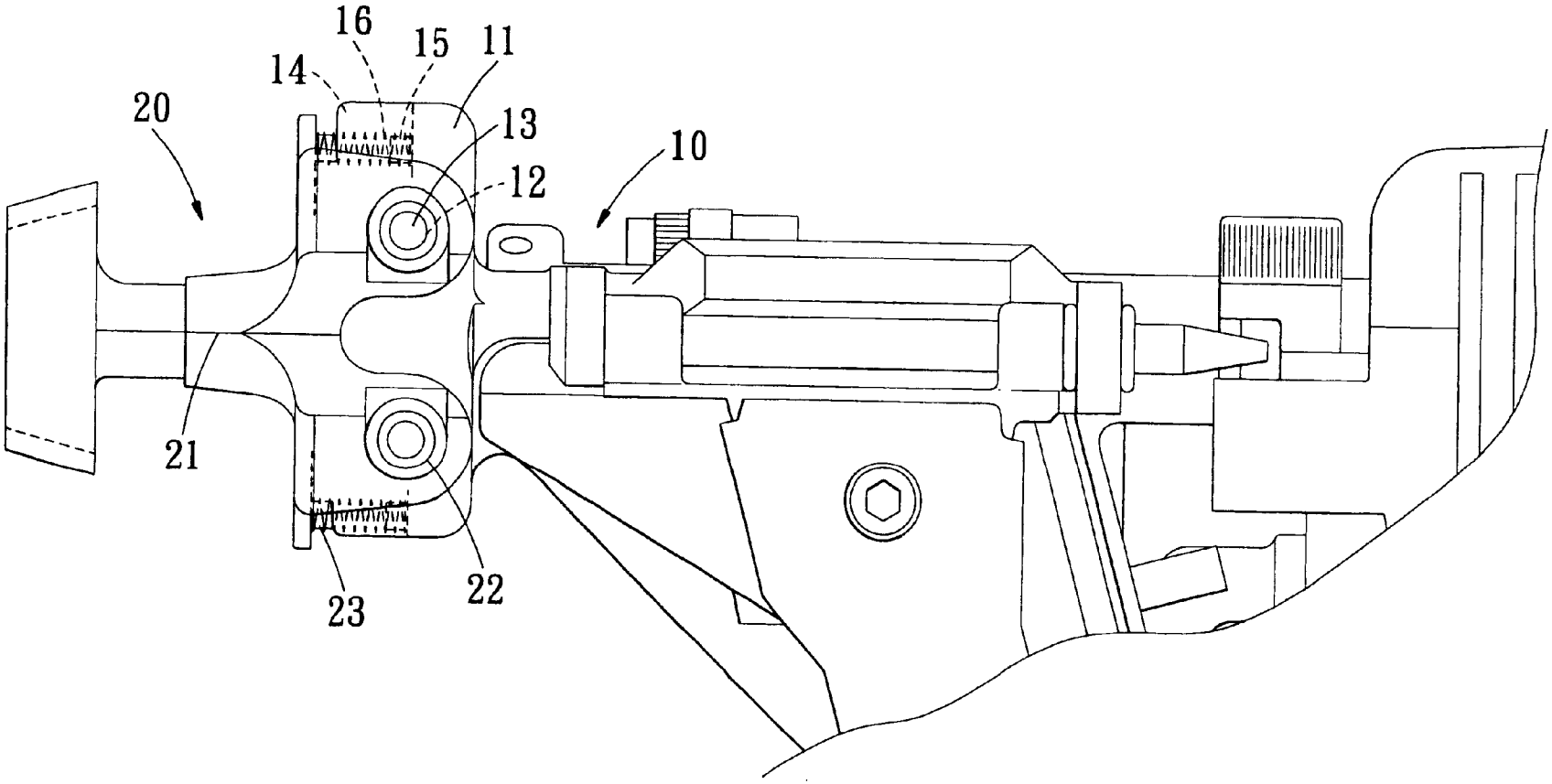
FIG. 1 PRIOR ART
FIG. 1 is a side elevational view of a conventional nail guide device for a power nailer.
Figure 2:
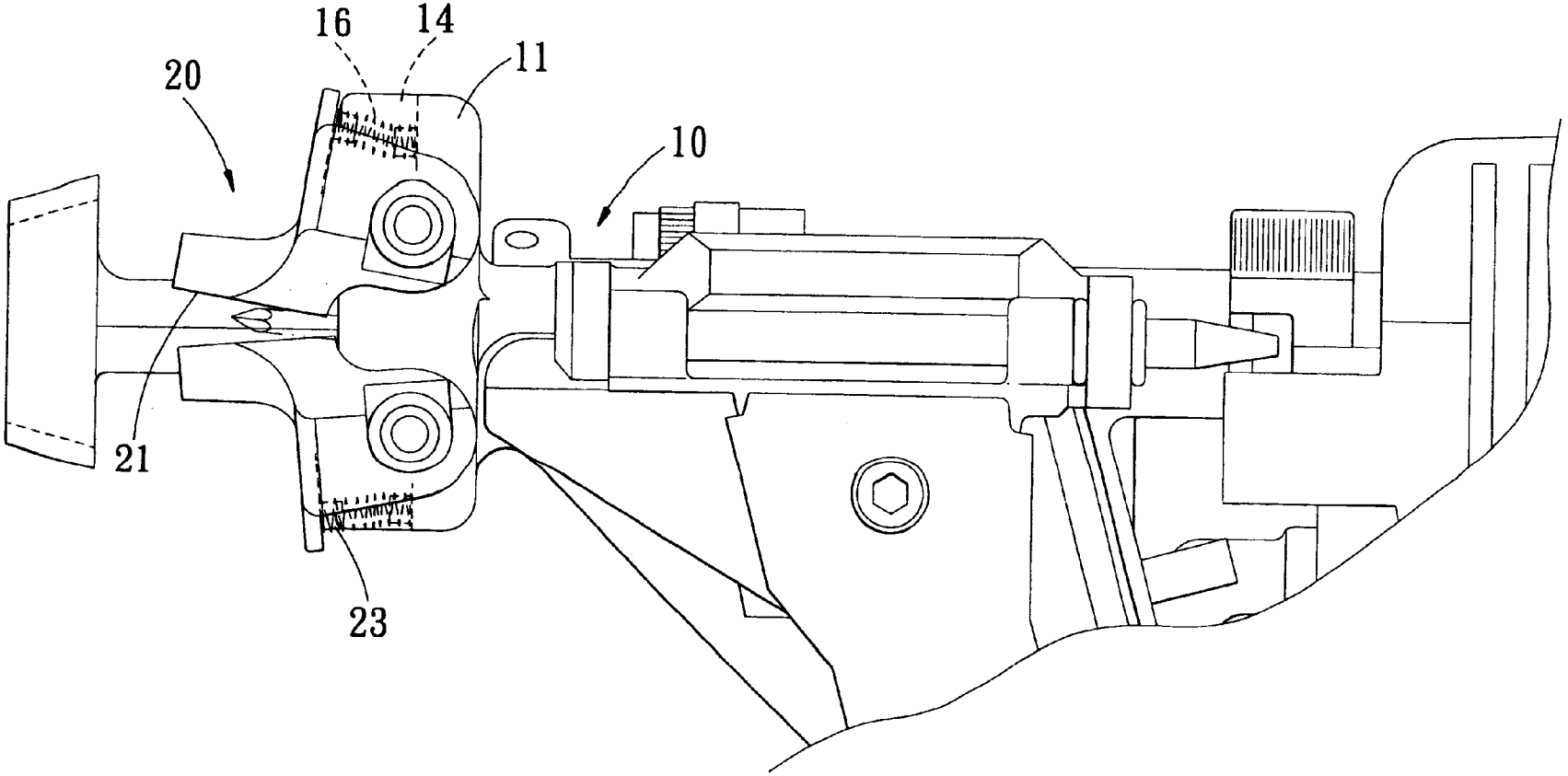
FIG. 2 PRIOR ART
FIG. 2 is a side elevational view of a conventional nail guide device for a power nailer to show a nail being obliquely ejected.
Figure 3:
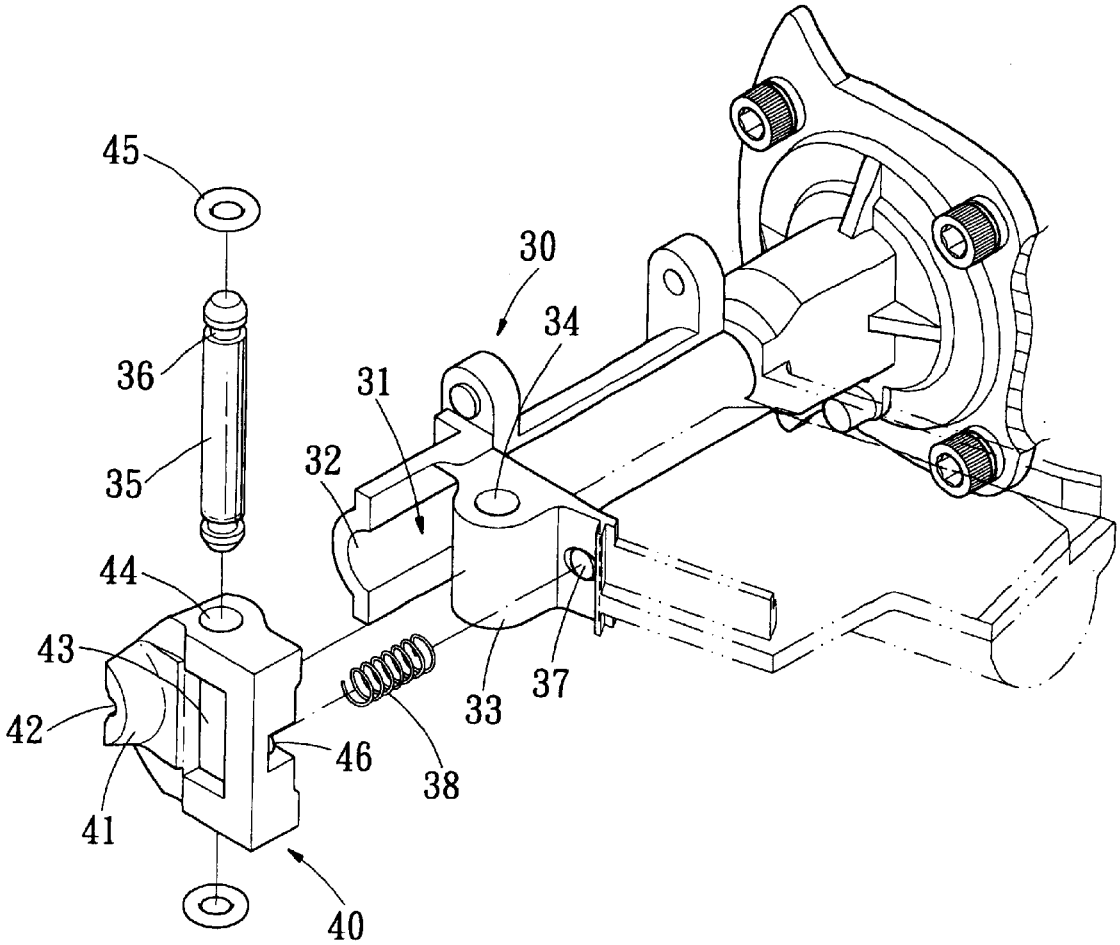
FIG. 3 is an exploded view of the nail guide device for a power nailer of the present invention.
Figure 4:
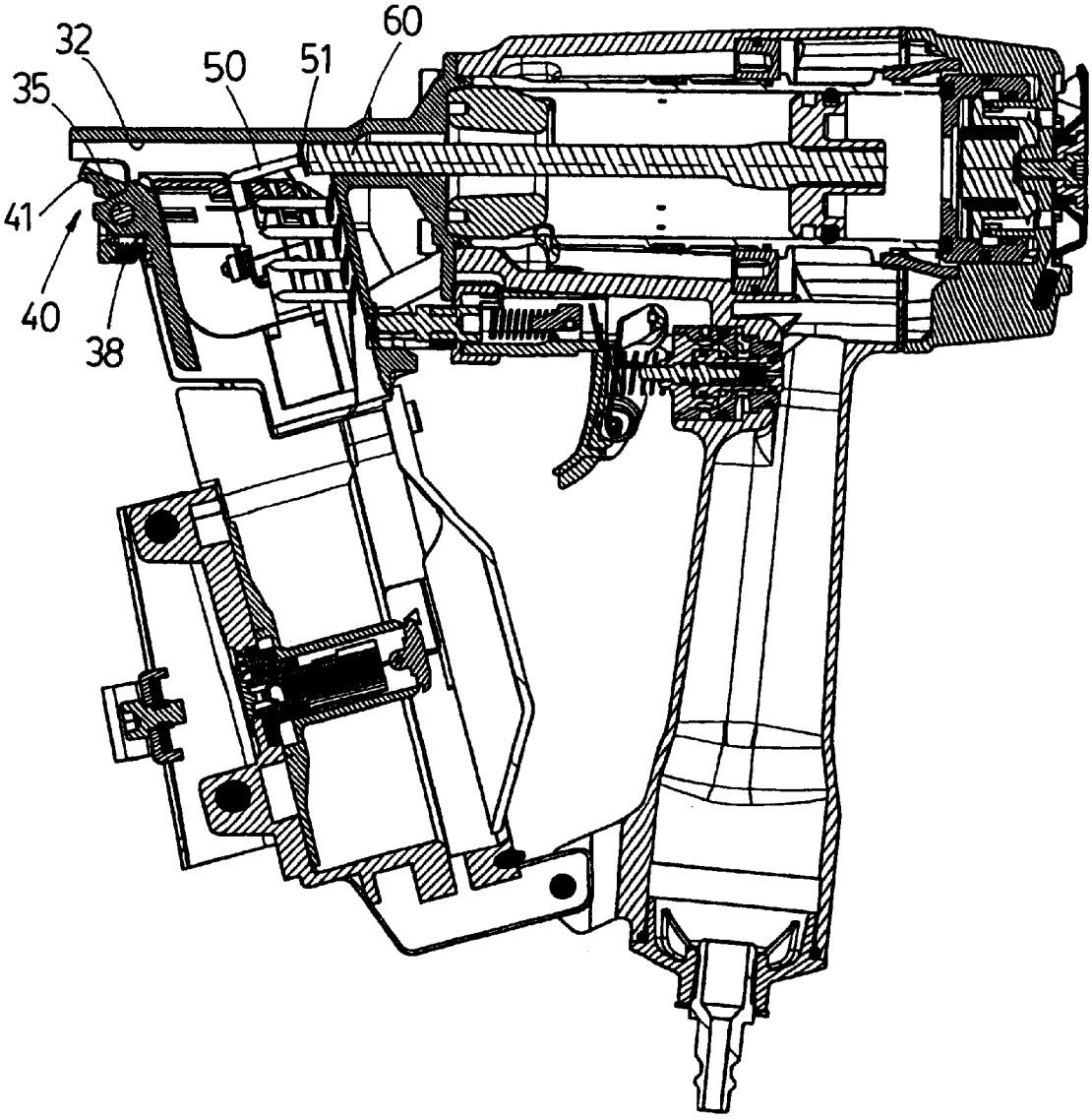
FIGS. 4–7 are cross sectional view illustrating the operation of the nail guide devices of the present invention.
Figure 5:
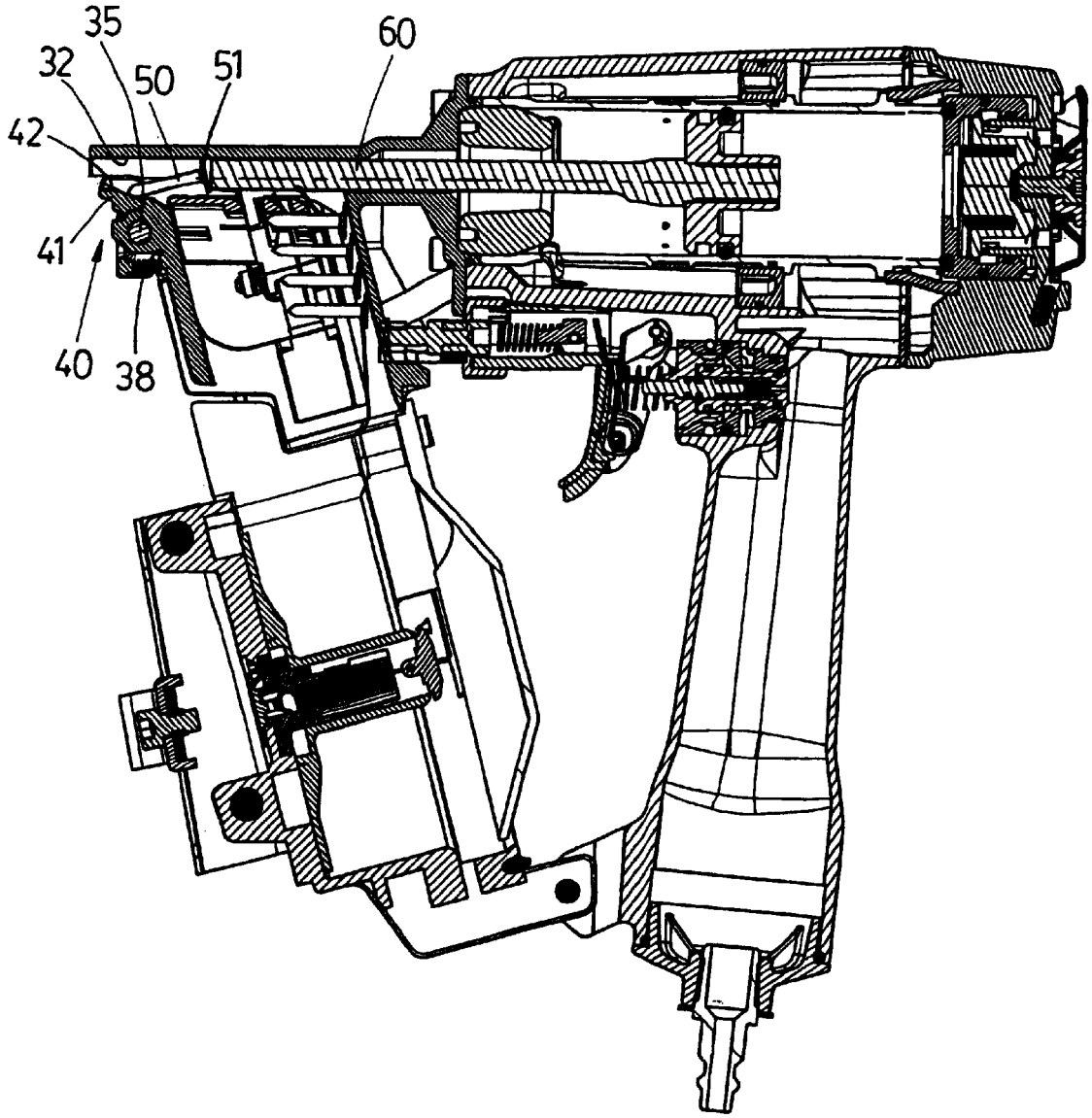
Figure 6:
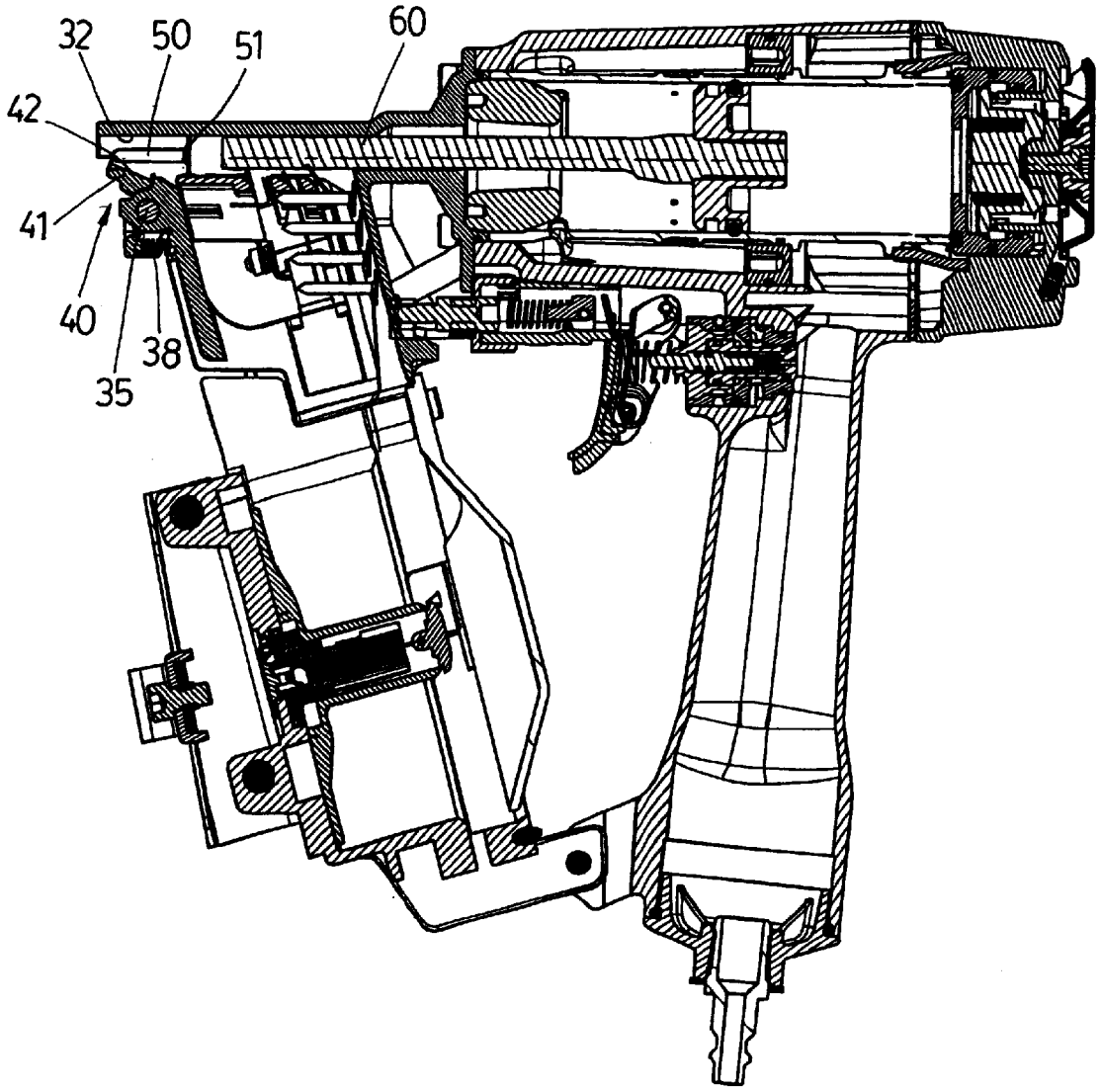
Figure 7:
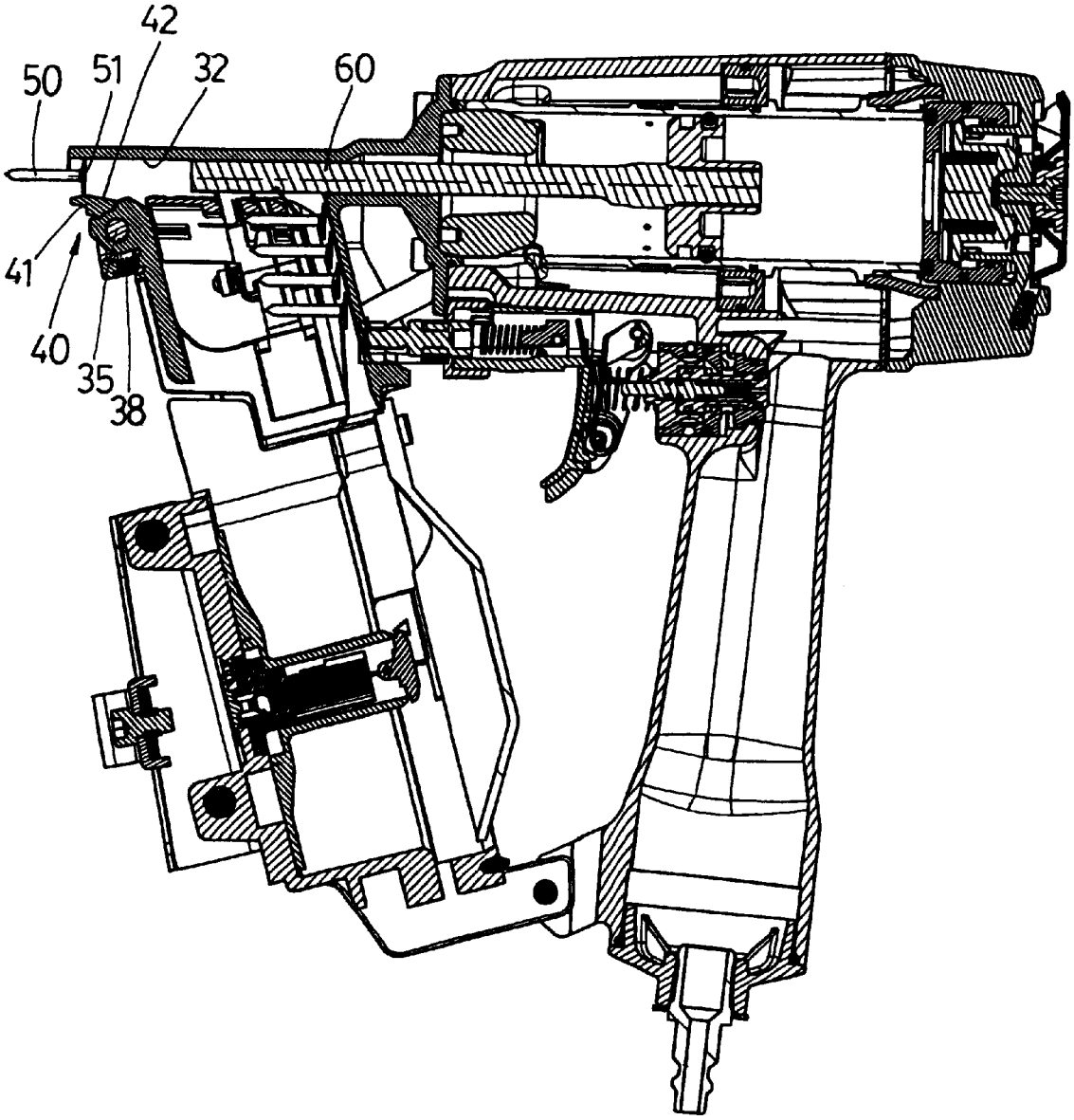

Referring to FIG. 3, the nail guide device of the present invention comprises a nose portion 30 and a guiding member 40. The nose portion 30 includes a notch portion 31 having a semi-circle passage 32 for driving the nails into a work piece. A lower portion of the notch portion 31 is formed a connecting portion 33. A pivot hole 34 is defined at the connecting portion 33 for rotatably receiving a pin 35 which has two circular grooves 36 formed thereon. A protrusion 37 is formed below the connecting portion 33. The guiding member 40 includes a leading edge 41 having a passage 42 formed thereon so as to opposite to the notch portion 31 of the nose portion 30. The guiding member 40 includes an opening 43 intersecting with an orifice 44 which can be installed on the pin 35 in correspondence with the pivot hole 34. Two retainer rings 45 are respectively mounted to the circular grooves 36 so that the nose portion 30 and the guiding member 40 can be assembled together. A bulge 46 is formed at the lower position of the opening 43 and a spring 38 engaged between the bulge 46 and the protrusion 37. The guiding member 40 is fixed to the connecting portion 33 by the pin 35 passing through the orifice 44 of the guiding member 40 and the pivot hole 34 of the connecting portion 33. The passage 42 of the leading edge 41 contacts against the inside of the semi-circle passage 32 by the virtue of the elasticity of the spring 38.

Referring to FIGS. 4–7, which show a series of nailing guide process when a nail 50 passes through the nose portion 30. A nail 50 obliquitous moves forward along the semi-circle passage 32 before reaching the guide member 40 because the nail 50 is driven by a ram 60, it is also simultaneously affected by the strength originated from a tying member 53 which adheres the nails 50 together. Hence, the nail 50 is guided again to the course parallel to the axis of the nose portion 30 when it touches the passage 42 of the leading edge 41 of the guiding member 40. In addition, due to the semi-circle passage 32 of the notch portion 31 cooperates with the guiding member 40, thereby guiding the nail 50 from tilting toward the center axis of the nose portion 30.

While we have shown and described various embodiments in accordance with the present invention, it should be clear to those skilled in the art that further embodiment may be made without departing from the scope of the present invention.

What is claimed is:

1. A nail guide device for a power nailer, comprising:

a nose portion formed a notch portion at a front end thereof, said notch portion having an semi-circle passage and a connecting portion, said connecting portion located below said semi-circle passage, said connecting portion having a pivot hole and a protrusion which located below said pivot hole, a pin received in said pivot hole and two circular grooves formed on said pin, a first end of a spring engaged to said protrusion;

a guiding member including a leading edge having a passage formed thereon so as to opposite to said notch portion of said nose portion, said guiding member including an opening intersecting with an orifice which can be installed on said pin in correspondence with said pivot hole, two retainer rings respectively mounted to said circular grooves so that said nose portion and said guiding member can be assembled together, a bulge being formed at the lower position of said opening and engaged with a second end of said spring.

* * * * *